US005380167A

United States Patent [19]

Burkett et al.

[11] Patent Number: 5,380,167

[45] Date of Patent: Jan. 10, 1995

[54] SWASH PLATE COMPRESSOR WITH UNITARY BEARING MECHANISM

[75] Inventors: Michael J. Burkett, Lockport; Nikolaos A. Adonakis, Grand Island, both of N.Y.

[73] Assignee: General Motors Corporation, Detroit, Mich.

[21] Appl. No.: 199,441

[22] Filed: Feb. 22, 1994

[51] Int. Cl.[6] ..... F04B 4/42

[52] U.S. Cl. ..... 417/269; 92/71; 74/60

[58] Field of Search ..... 417/269; 92/71; 74/60

[56] References Cited

U.S. PATENT DOCUMENTS

| | | | |
|---|---|---|---|
| 1,316,679 | 9/1919 | Brackett | 74/60 |
| 3,181,475 | 5/1965 | Thompson | 74/60 |
| 3,261,216 | 7/1966 | Woolfenden | 74/60 |
| 3,964,323 | 6/1976 | Seibert | 74/60 |
| 4,392,788 | 7/1983 | Nakamura et al. | 417/269 |
| 4,683,803 | 8/1987 | Miller et al. | 92/71 |
| 4,790,727 | 12/1988 | Steele | 417/269 |
| 5,201,261 | 4/1993 | Kayukawa et al. | 92/71 X |
| 5,236,312 | 8/1993 | Finn et al. | 417/269 |

*Primary Examiner*—Richard A. Bertsch
*Assistant Examiner*—M. Kocharov
*Attorney, Agent, or Firm*—Patrick M. Griffin

[57] ABSTRACT

A swash plate type automotive air conditioning compressor that minimizes part count while providing a more robust and improved operation. A large diameter, single slotted ball located in a matching socket in each piston overlies the outer edge of the swash plate. As the plate turns, the sides of the plate rub along the sides of the ball slot, and the ball twists within the socket, reciprocating the piston. The larger diameter surfaces of ball and socket are easier to machine accurately, and part count is reduced to a minimum. The larger contacting surface areas provide for better lubrication and lower pressure loading.

2 Claims, 2 Drawing Sheets

SWASH PLATE COMPRESSOR WITH UNITARY BEARING MECHANISM

This invention relates to automotive air conditioning compressors in general, and specifically to a swash plate type compressor with an improved and simplified bearing mechanism joining the swash plate to the pistons.

BACKGROUND OF THE INVENTION

Automotive air conditioning compressors require a simple and compact drive means for translating rotation of a drive shaft into axial reciprocation of a number of pistons. One of the most common mechanisms is the so called swash plate, an annular disk that rotates one to one with the shaft, but which is slanted with respect to the shaft, rather than perpendicular thereto. As the shaft rotates, diametrically opposed points near the outer edge of the swash plate shift axially back and forth in opposite directions. This axial motion of the plate can be translated into axial motion of the pistons through a suitable bearing joining the plate to the pistons. Such a bearing mechanism must provide a translational degree of freedom, plus at least two rotational degrees of freedom. Consequently, it is subject to a good deal of friction and continually reversing loading.

The two most common bearing mechanisms use a pair of relatively small balls for each piston, one on each side of the swash plate near its outer edge. The older version of the two ball mechanism uses completely round balls, which turn in small sockets in the piston on one side and which slide on the other side on separate so called "shoes" on the surface of the plate. The shoes are typically bronze or some other friction reducing wear material. An example may be seen in U.S. Pat. No. 4,392,788 to Nakamra et al. Four pieces all together, two balls and two shoes, must be sized and assembled relative to the swash plate thickness to assure that all tolerances are taken up. A newer version of the two ball mechanism eliminates the shoes as a separate piece by flattening off the plate side of the balls and coating them with a wear reducing layer. An example may be seen in U.S. Pat. No. 4,790,727 to Steele. This reduces the piece count by two, but it is substantially more expensive than providing plain, round balls. A substantially different approach is disclosed in U.S. Pat. No. 4,683,803, co assigned, in which a pair of gum drop shaped plastic bearing members, integrating the shoe and ball functions, are loaded under compression between piston sockets and the swash plate. While potentially eliminating the steps of sizing the separate pairs of shoes and balls in favor of a single size, single material plastic piece, two such plastic pieces are still necessary for each piston, and the design has not found its way into production.

SUMMARY OF THE INVENTION

The invention provides a significant departure from past practice by providing a single, unitary bearing mechanism between each piston and the plate edge, reducing part count to an absolute minimum. Conventional materials are used, manufacturing and assembly are simplified, and operation improved.

In the preferred embodiment disclosed, a multi cylinder swash plate type compressor uses a conventional, fixed angle swash plate and a plurality of double acting pistons. The swash plate thickness is known quantity, within normal manufacturing tolerances. Closely fitted into each piston socket is a single ball formed from a suitable wear resistant material, such as bronze. A central slot is machined into the ball to fit axially closely, but with radial clearance, over the swash plate edge. As the plate turns, its edge slides through the ball slot, twisting the ball in the socket and reciprocating the pistons. The single ball provides several advantages in addition to the part count minimization. Tolerance stack ups are reduced, and only the plate thickness and slot thickness need to be matched at assembly. The larger, singular spherical surfaces of ball and socket are simpler to machine accurately, and are more robust, distributing lubricant, wear and loading more widely and evenly.

DESCRIPTION OF THE PREFERRED EMBODIMENT

These and other features and advantages of the invention will appear from the following written description, and from the drawings, in which.

Figure 1:
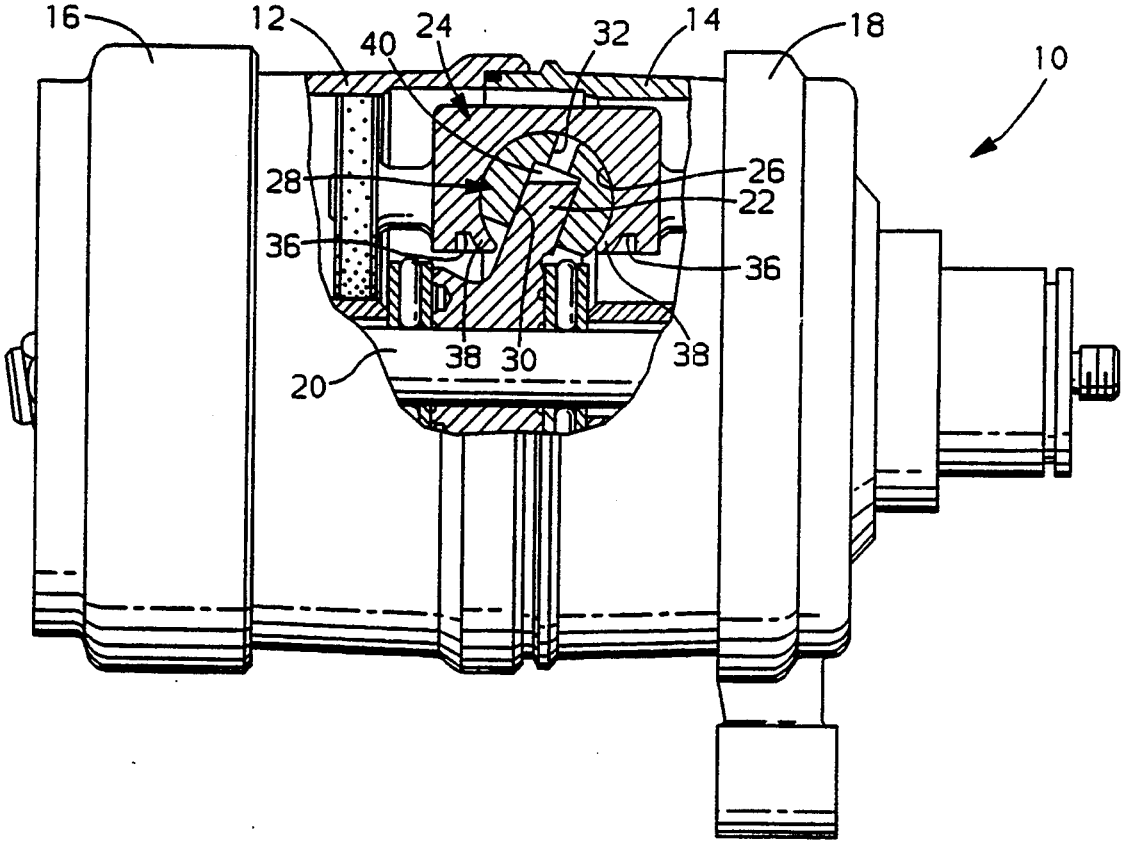
FIG. 1 is a side view of a compressor made according to the invention with part of the shell broken away to reveal the swash plate and one piston and bearing in cross section.

Referring first to FIG. 1, a swash plate type automotive compressor according to the invention, indicated generally at 10 is conventional as to size and as to the majority of its components. A similar compressor is disclosed in U.S. Pat. No. 4,683,803, referred to above and incorporated herein by reference. A pair of mating, three cylinder blocks 12 and 14 are enclosed by heads 16 and 18. A central drive shaft 20 is rotatably supported within blocks 12 and 14 and powered by an engine driven drive belt, not illustrated. A swash plate 22 is fixed to shaft 20 and rotates one to one with it, at a fixed angle. The axial thickness of plate 22 is known, within an expected tolerance range. One of three double sided pistons is indicated generally at 24. Pistons 24, machined from aluminum, are supported within the blocks 12 and 14 so as to be axially reciprocable about the axis of shaft 20. The pistons 24 are driven by swash plate 22 through a mechanism that consists only of a socket 26 machined centrally in piston 24, and a bearing member in the form of a ball, indicated generally at 28. Further details are described below.

Figure 3:
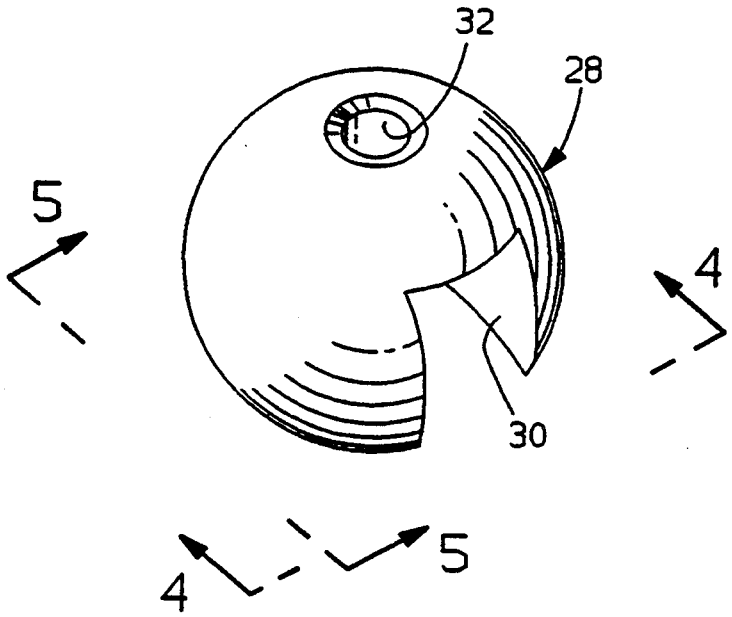
FIG. 3 is a perspective view of one ball.
Figure 4:
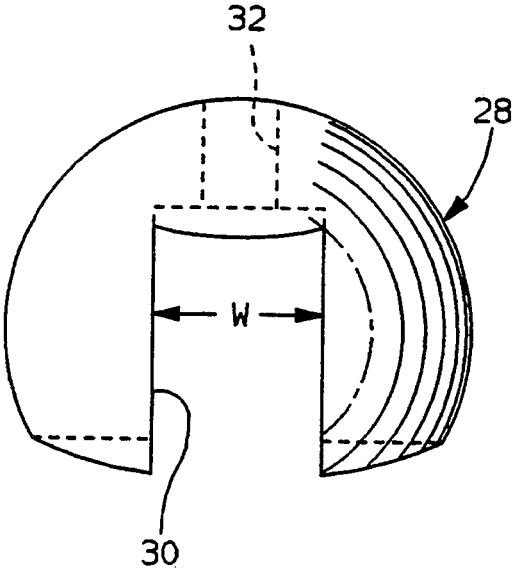
FIG. 4 is a view of the ball from the perspective of line 4—4 in FIG. 3.
Figure 5:
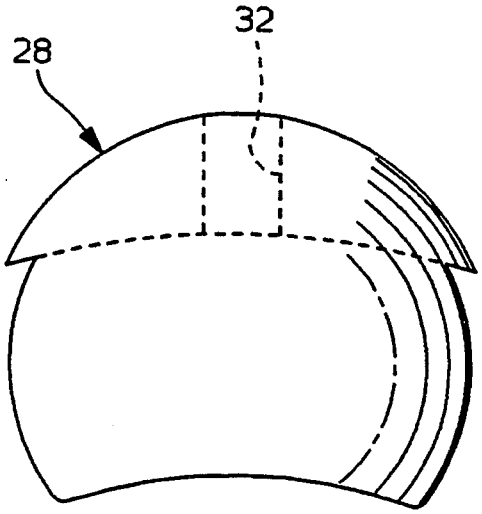
FIG. 5 is a view of the ball from the perspective of line 5—5 in FIG. 3.

Referring next to FIGS. 3 through 5, ball 28 is a solid, unitary piece, machined or otherwise formed from a suitable wear resistant bearing material, such as bronze. It has a central slot 30 with a width W that closely matches the thickness of plate 22. The width of slot 30 accounts for the acorn cap appearance of ball 28 as seen in FIG. 5, since a significant portion of the outer envelope of ball 28 is cut away. In practice, slot 30 could not be cut with absolute precision any more than the thickness of plate 22. Therefore, a supply of balls 28 would be slotted, gauged, and inventoried in classes of widths, the classes being as finely divided as necessary to achieve the closeness of fit up that the ultimate assembler wished to achieve. This is standard assembly process for mechanisms such as ball bearings where ball to pathway fit is important for maintaining proper bearing preload. Another feature of ball 28 is a lubrication passage 32 drilled through the top center and opening into slot 30.

Figure 2:
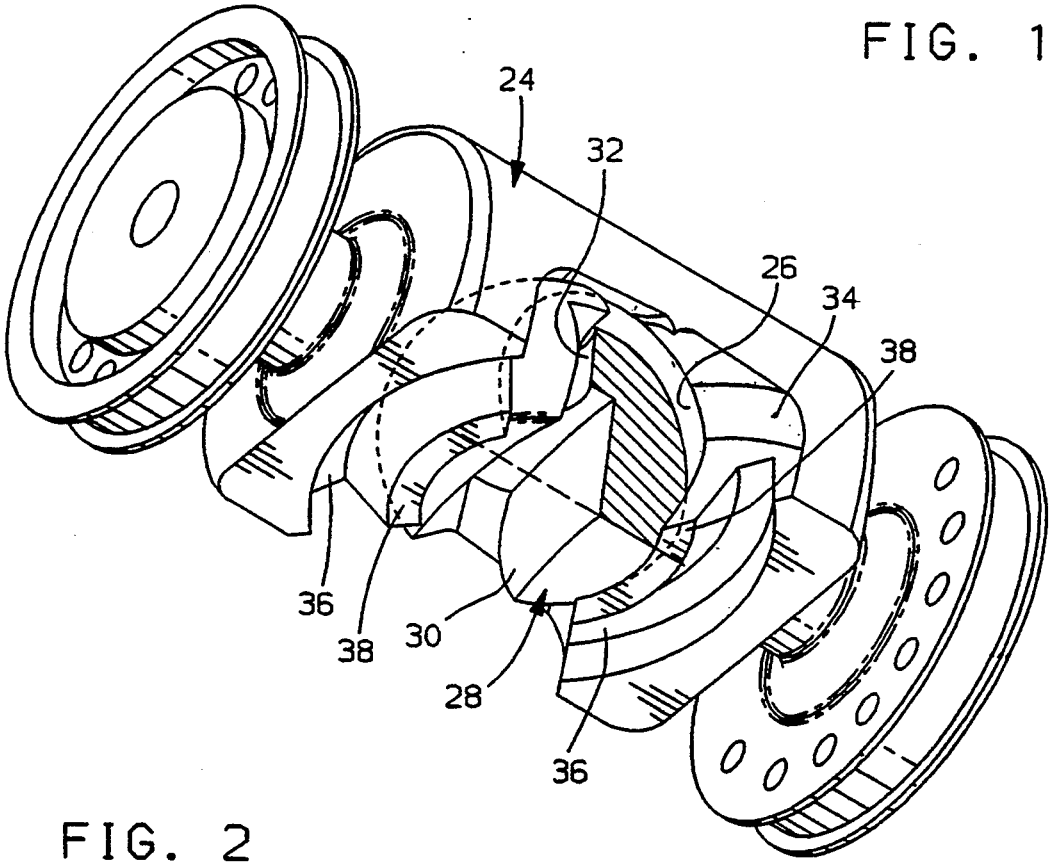
FIG. 2 is a perspective view of one piston and its associated bearing.

Referring next to FIGS. 1 and 2, piston socket 26 comprises a semi spherical bridge spanning a larger central cutout 34 in piston 24. Socket 26 is relatively narrow as measured normal to the central axis of piston 24, but is long in the circumferential direction, covering just over 180 degrees when fully formed, with an inside diameter that closely matches the outside diameter of ball 28. Besides being a single, continuous surface, socket 26 is much larger in diameter than the two separate and smaller sockets that would have to be machined two accept the two smaller balls of a conventional compressor. Socket 26 is thus easier to machine, both in terms of speed and accuracy. Bordering the ends of socket 26, two semi annular grooves 36 create a pair of semi circular flanges 38 which remain more or less straight before assembly. At assembly, after the thickness of plate 22 has been gauged and the proper sized balls 28 chosen and inserted in sockets 26, the flanges 38 are swaged in to make socket 26 larger than 180 degrees, thereby retaining ball 28 in the socket 26. Only one component has to be gauged and assembled, which represents an absolute minimization of parts. The axial fit up between plate 22 and ball slot 30 is as precise and close as the division of part classes referred to above allows, but there is a radial space or clearance 40 between the edge of plate 22 and bottom of slot 30.

Many operational advantages flow from the simplicity and size of the single ball 28, as well. As plate 22 rotates, its edge slides through slot 30 and ball 28 is twisted back and forth within socket 26 in a precessing motion, reciprocating the pistons 24. As ball 28 moves, there is as much or more sliding surface area in contact between the sides of slot 30 and the sides of plate 22 than would be the case with conventional sliding shoes or flat sided balls. There is much more rotating surface area in contact between socket 26 and ball 28 than would be the case with a conventional pair of much smaller diameter balls. These contacting surface areas are well lubricated, since gaseous refrigerant entering the compressor 10 has lubricant entrained in it. This lubricant can reach the interface between the inner surface of socket 26 and the outer surface of ball 28 both through the cutout 34, and through the ball lubrication passage 32, which moves off of the socket surface 26 and is thereby uncovered regularly as ball 28 twists back and forth. The radial clearance 40 referred to above prevents rubbing on the bottom of slot 30, and continually changes shape as ball 28 twists around, which should create a lubricant pumping action. The larger contacting surface area between socket 26 and ball 28 also reduces pressure loading and reduces the chance of deformation and slop in the part fit up considerably over time. This increases part life and reduces noise, as well. Fewer parts, in addition to reducing assembly time, also reduces the net effect of differential thermal expansion between differing materials.

Variations in the preferred embodiment could be made. A compressor with a variable angle swash plate, which is used to vary compressor capacity with cooling demand, could also be used. Materials other than aluminum and bronze for the piston 24 and ball 28 could theoretically be used. In fact, the larger contacting surfaces and lower pressure loadings could be ideally suited to lower strength materials. A socket surface wider than 26 could be used, although it would be more difficult to machine, and probably more difficult to lubricate. Therefore, it will be understood that it is not intended to limit the invention to just the preferred embodiment disclosed.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. An air conditioning compressor, comprising, a swash plate rotatable about an axis and having an annular edge and a predetermined axial thickness, a plurality of pistons, each of which has a body in which a single, integral semi spherical socket is formed, and, a unitary, solid spherical bearing member in and directly contacting said socket having an outside diameter that closely matches said socket and a central, flat sided slot cut partially therethrough which receives the edge of said swash plate axially closely and with sufficient radial clearance to allow said annular edge to clear said slot as said swash plate rotates, whereby, as said swash plate rotates, said swash plate edge slides through said bearing member slot, said bearing member twists within said socket, and said piston is axially reciprocated.

2. In an air conditioning compressor having a swash plate rotatable about an axis with an annular edge of predetermined thickness and flat sides proximate to said edge, and also having a plurality of pistons, each of which has a body portion and which is supported within said compressor so as to be axially reciprocable parallel to said axis, a drive mechanism for each of said pistons that consists of:

a single, integral semi spherical socket formed in the body portion of each of said pistons, and, a unitary spherical bearing member rotatable directly in said socket having an outside diameter that closely matches said socket and a central, flat sided slot cut partially therethrough which receives the edge of said swash plate axially closely but with sufficient radial clearance to allow said annular edge to clear said slot and to allow said swash plate flat sides to slide radially along said slot flat sides, thereby allowing said spherical bearing member to twist within said integral socket as said pistons are reciprocated.

* * * * *